United States Patent [19]

Reynolds

[11] 4,066,366

[45] Jan. 3, 1978

[54] CAR WASH MOP

[76] Inventor: Donald F. Reynolds, 4415 E. Textile Road, Ypsilanti, Mich. 48197

[21] Appl. No.: 720,953

[22] Filed: Sept. 7, 1976

[51] Int. Cl.[2] ..... A46B 11/04; A47L 13/22

[52] U.S. Cl. ..... 401/285; 401/288; 401/289

[58] Field of Search ..... 401/289, 285, 291, 288, 401/290, 286, 268, 203, 40, 42; 15/228, 229 B

[56] References Cited

U.S. PATENT DOCUMENTS

| | | | |
|---|---|---|---|
| 591,570 | 10/1897 | Poor | 401/289 |
| 1,142,966 | 6/1915 | Jennings | 401/42 |
| 1,199,646 | 9/1916 | Witherly | 401/285 X |
| 2,190,599 | 2/1940 | Jones | 401/285 |
| 2,350,469 | 6/1944 | Litka | 401/289 |
| 2,685,702 | 8/1954 | Jones | 401/288 |
| 2,940,103 | 6/1960 | Czapar | 401/42 |

*Primary Examiner*—Stephen C. Pellegrino
*Attorney, Agent, or Firm*—Olsen and Stephenson

[57] ABSTRACT

A car wash or polishing mop is provided comprising an elongated hollow handle open at one end for connection to a water supply; the other end defining a hollow transverse cross member open at laterally extending ends through which water can be discharged. A tubular frame assembly, having apertures through which the water or other fluid can discharge, is pivotally connected to the laterally extending ends of the transverse cross member so that during use pivotal movement of the frame assembly relative to the handle can occur. A mop head fits over the tubular frame assembly to aid in the distribution of water and to facilitate the cleaning of the surface of an automobile.

10 Claims, 4 Drawing Figures

CAR WASH MOP

BACKGROUND OF THE INVENTION

The present invention relates to car wash or polishing mops having a wash or polishing head from which water or other cleaning or polishing fluids can be discharged during cleaning or polishing operations.

It is known to provide cleaning and polishing devices of the foregoing character, but such prior devices are not fully satisfactory for use by individuals desiring to wash or polish their own motor vehicles. These prior art devices include brush or mop heads which receive supplies of fluid through relatively long hollow handles to aid the individuals in applying the fluids to the vehicle surfaces. However, most of them do not lend themselves readily to washing or polishing the surfaces of modern motor vehicles, because the mop or brush heads cannot in a convenient manner follow the contours of the surfaces to the extent necessary to perform satisfactory cleaning or polishing.

Car wash mops have been developed with wash heads that are pivotally movable, but they are unduly heavy for convenient use and are excessively complex and costly. Thus, some of these wash mops either have the wash heads located below pivotal mountings as shown, for example, in U.S. Pat. No. 1,377,805, issued Sept. 3, 1918 to Wengers, or provide for means external to the handle to convey water into the wash head positioned below the pivotal mounting, as shown for example in U.S. Pat. No. 2,685,702, issued Aug. 10, 1954 to Jones. Such devices are unsatisfactory from the operation standpoint and also are costly to fabricate.

SUMMARY OF THE INVENTION

The present invention has surmounted the shortcomings of the prior art and provides a car wash mop having a wash head that pivotally connects to a hollow handle in a simple efficient manner. As a result of this novel design, a low cost, simple to operate car wash mop can readily be obtained by automobile owners.

According to one form of the present invention, a car wash mop is provided comprising an elongated hollow handle having one end open for connection to a water supply. Any suitable connection, such as a threaded hose coupling having a water valve will adequately fulfill the connecting requirements. The other end of the handle comprises a hollow transverse cross member having laterally extending ends through which water can be discharged. A passageway is thus defined extending from the open end of the handle to the laterally extending ends of the transverse cross member. A reservoir for a soap, wax, or other like solutions is disposed in the hollow handle of the wash mop. An outlet port is formed at one end of the reservoir near the cross member through which a supply of soap is continually discharged to mix with the water prior to being discharged from the wash mop. The other end of the reservoir, near the open end of the handle, has an opening through which the soap is deposited into the reservoir.

A tubular frame assembly is pivotally connected at its midportion to the laterally extending ends of the transverse cross member to provide for pivotal movement of the frame assembly relative to the handle. The tubular frame assembly includes a tubular frame member formed as two reverse loops to define an eight-shaped configuration having its ends at the midportion of the eight-shaped configuration. The ends are joined to the outer ends of the transverse cross member by connecting means such as a pair of externally threaded sleeves. Each sleeve has an axial passage through which an end of the frame member extends, the tip of which is flared. A compression spring is disposed in the transverse member to urge the flared tip against the threaded sleeves when the tubular frame assembly is mounted on the handle. This arrangement provides a tight rotatable seal between the tubular frame member and the threaded sleeves.

A mop head is provided which is adapted to fit over the frame assembly and has a pocket portion that receives the frame assembly so as to be held thereon and to permit easy replacement of worn mop heads. Flexible swabbing material such as a plurality of cloth-like strands is attached to the pocket to aid in cleaning and dislodging dirt without scratching the surfaces being cleaned. To further facilitate the distribution of water, the mop head is perforated with a plurality of apertures, each of which is in close proximity to the apertures of the tubular frame assembly when the car wash mop is assembled.

By virtue of the lightweight and simple construction of the car wash mop and the unique arrangement for allowing controlled movement of the mop head relative to the handle, a low cost but durable and efficient car wash mop has been provided especially adapted for cleaning or polishing modern motor vehicles. Thus, it is the object of the present invention to provide an improved car wash mop.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a perspective view of an assembled car wash mop embodying the present invention;

FIG. 4 is a partial fragmentary and sectional view of a soap reservoir used with the wash mop of the present invention.

DESCRIPTION OF THE PREFERRED EMBODIMENT

Figure 3:
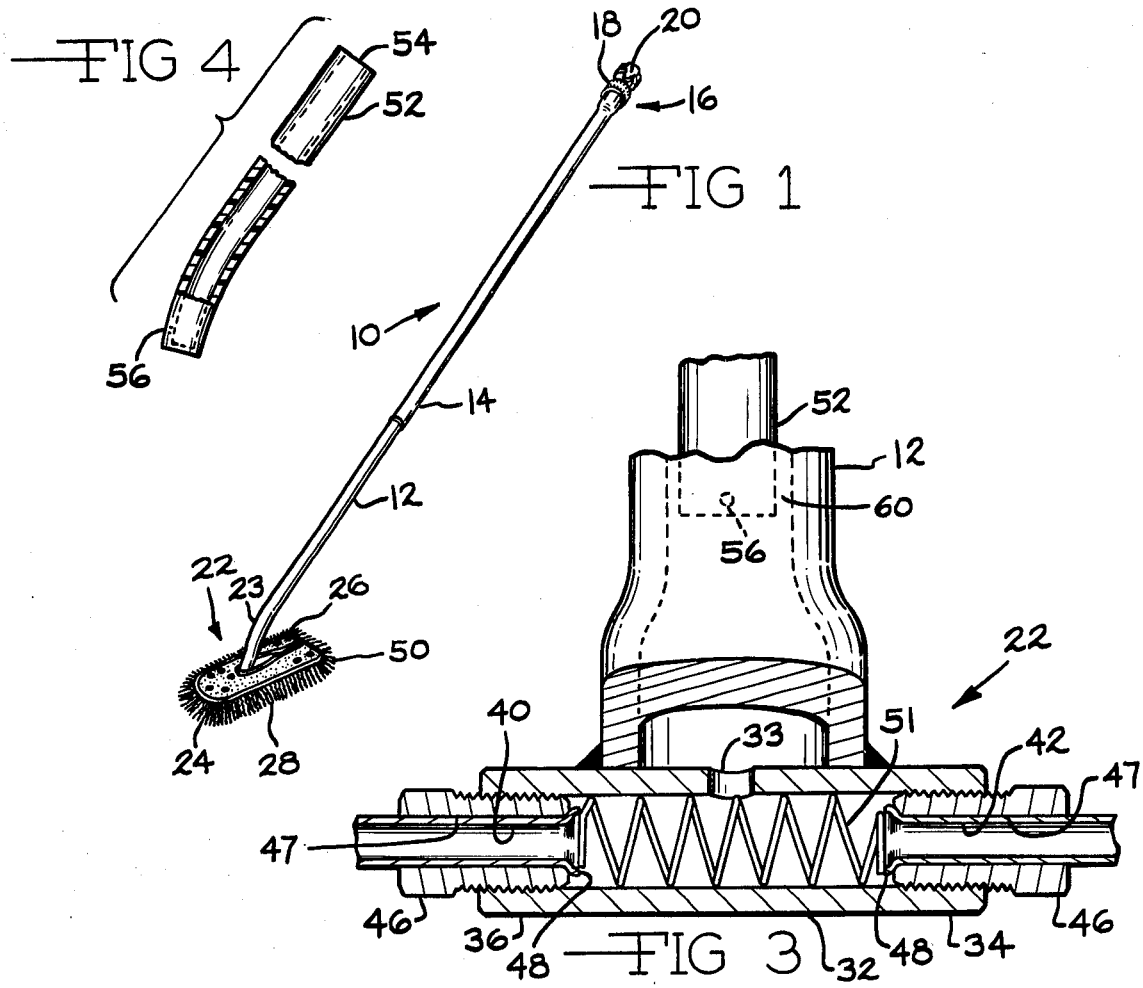
FIG. 3 is an enlarged fragmentary sectional view taken at the line 3—3 of FIG. 2.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring to the drawings, the embodiment of the invention, shown in FIGS. 1-4 will now be described in greater detail. The car wash mop 10 is shown in FIG. 1 having an elongated handle 12. A hand grip 14, formed of suitable material such as rubber, vinyl or the like, is attached to the handle 12 where it will be held while being used so as to facilitate gripping of the car wash mop 10 during cleaning operations. The handle 12 is of a tubular type having a hollow passageway to allow passage of water or other fluids therethrough. At one end 16 of the handle 12, a fitting such as a hose coupling 18 is provided in order to connect the car wash mop 10 to a water supply. A control valve 20 is provided at the coupling 18 for control of the flow of water while using the car wash mop 10.

At the other end 22 of the handle 12, a hollow transverse member 32 is formed with laterally extending ends 34 and 36 which are in communication with the handle 12 by the port 33. Thus, a passageway is defined from the end 16 of the handle 12 to the laterally extending ends 34 and 36 of the transverse member 32 for lateral discharge of fluid.

At the other end 22 of the handle 12, a wash mop head 24 is provided to aid in the distribution of water or detergent solution and to insure that no scratches are imparted to the car's surface as dirt and grime are being dislodged. The mop head 24 includes a pocket 26 that fits over the tubular frame assembly 30. Such construction allows easy replacement of worn mop heads. Flexible fabric, such as thread-like strands 28, is attached to the pocket enabling effective cleaning and distribution of the water.

A tubular frame assembly 30 is pivotally connected at the outer ends 34 and 36 of the transverse member 32 to provide for pivotal movement of the mop head 24 relative to the handle 12. The frame assembly 30 comprises a tubular frame member 38 formed in the shape of a pair of loops or a generally eight-shaped configuration having ends 40 and 42 located at the midportions of the generally eight-shaped configuration. The frame member 38 has a plurality of apertures 44 formed therein through which water, a detergent solution, fluid wax, or the like can be discharged. Although the disclosed configuration of the frame member 38 is generally eight-shaped, other suitable configurations are contemplated. The important requirement of any configuration is that the frame assembly be in substantially one plane and that its ends be located in the midportion and pivotally mounted to be in communication with the transverse member 32 so that substantially equal portions of the frame assembly 30 are on either side of the hollow transverse member 32.

The frame assembly 30 further includes connecting means such as a pair of externally threaded sleeves 46 which telescope into the laterally extending internally threaded ends 34 and 36. Each sleeve 46 is formed with a bore 47 through which extends one of the ends 40 or 42 of the frame member 38. Sufficient clearance is provided so that the frame member 38 may freely pivot in the sleeves 46. The tips 48 of the ends 40 and 42 are flared, and a compression spring 51 which is disposed in the member 32 urges the flared tips 48 into engagement with the sleeves 46 when the frame assembly 30 is mounted on the handle 12. Thus, a rotatable seal is provided between the frame member 38 and the sleeves 46.

Figure 2:
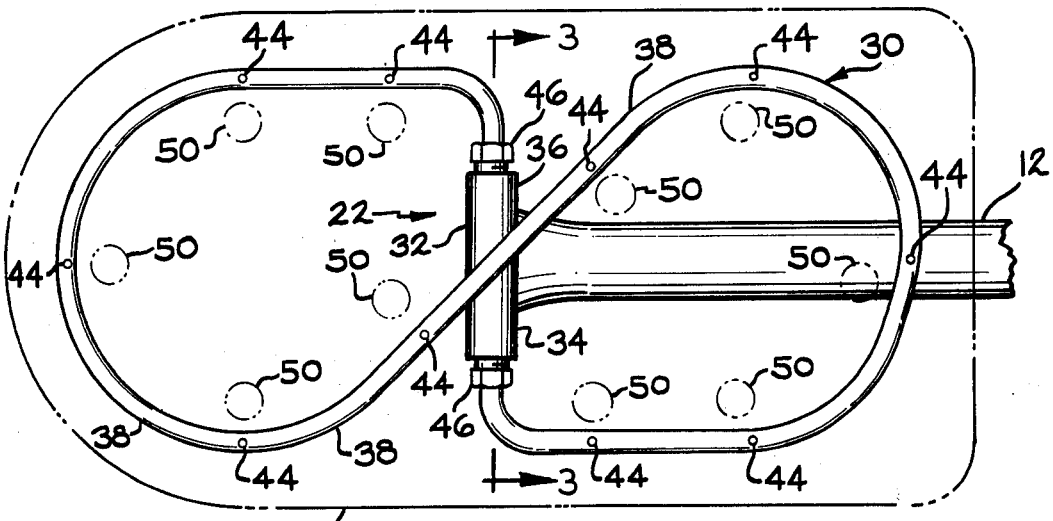
FIG. 2 is an enlarged fragmentary bottom plan view of the tubular frame assembly showing the mop head in broken lines.

As can best be seen in FIGS. 1 and 2, the mop head which fits over the tubular frame assembly 30 includes a plurality of perforations 50 that are formed therein. The perforations 50 extend through both the top and bottom of the pocket 26 are in close proximity to the apertures 44 of the tubular frame assembly 30 to thereby aid in the distribution of the water or other fluid. A reservoir 52, shown in FIG. 4, for cleaning, waxing solutions or the like is located within the handle 12 and is formed to a tubelike configuration having an access opening 54 at one end and a discharge port 56 at the other end having an opening area substantially smaller than the opening area of the access opening 54. The reservoir 52 is formed of semi-flexible material such as plastic or the like and extends over substantially the entire length of the handle 12 with the access opening 54 being located near the end 16. The bent portion 23 of the handle 12 prevents the reservoir 52 from further downward positioning. The coupling 18 also serves to retain the reservoir 52 within the handle 12.

The outer diameter of the reservoir 52 is smaller than the inner diameter of the handle 12 to provide a sufficient clearance 60 which allow proper flow of fluid through the handle 12. It has been found that a one-sixteenth of an inch clearance between the reservoir 52 and the handle 12 is adequate to allow proper flow of fluid through the handle 12. In operation, the pressure of the incoming fluid acts against the open end 54 of the reservoir 52 maintaining the solution in the reservoir 52. As the incoming fluid flows past the outlet port 56 a pressure differential is created between the access opening 54 and the discharge port 56 enabling the solution within the reservoir 52 to be continuously discharged as the fluid is flowing through the handle 12.

If it is desired to use the wash mop 10 without any cleaning solution, the reservoir 52 can be left empty in the handle 12 or it can be readily removed from the handle 12 after the coupling 18 has been removed.

In operation, a water or other liquid supply is connected to the car wash mop 10 by suitable means such as a common garden hose (not shown). The hose coupling connection 18 which has a control valve 20 serves as suitable means for connecting the handle to the water supply and for controlling its flow. The reservoir 52 provides a continuous discharge of soap or the like. The flexible mop head 24, which easily detaches from the tubular frame assembly 30, permits quick replacement of worn out mop heads 24.

As the car wash mop 10 is used to clean the car, the mop head 24 will readily conform to the various contours of the surface of an automobile by pivoting about the transverse member 32. Thus, at all times the maximum area of the mop head 24 will be in contact with the car's surface to effectively clean the car while protecting its finish.

What is claimed:

1. A car wash mop comprising an elongated handle open at one end for connection to a source of liquid and having for its other end a transverse member open at laterally extending ends, said handle being hollow so as to define a passageway for liquid extending from said one end to said other end for discharge through said laterally extending ends, a tubular frame assembly having ends pivotally connected to said laterally extending ends for pivotal movement relative to the handle and so as to be in communication with said passageway, said tubular frame assembly having a plurality of apertures for discharge of liquid flowing from said passageway, and a flexible mop head fitted over said tubular frame assembly, said tubular frame assembly including a frame member having a generally eight-shaped configuration, and said ends of the frame assembly are at the midportion of the generally eight-shaped configuration in endwise facing relationship.

2. The car wash mop that is defined in claim 1 further including a fluid reservoir located in said hollow handle, said reservoir having an access opening at one end thereof in communication with liquid being supplied to said hollow handle and a discharge port at the other end thereof.

3. The car wash mop that is defined in claim 2 wherein said reservoir is an elongated tube extending over substantially the entire length of said handle.

4. A car wash mop comprising an elongated handle open at one end for connection to a source of liquid and having for its other end a transverse member open at laterally extending ends, said handle being hollow so as to define a passageway for liquid extending from said one end to said other end for discharge through said laterally extending ends, a tubular frame assembly having ends pivotally connected to said laterally extending ends for pivotal movement relative to the handle and so as to be in communication with said passageway, said tubular frame assembly having a plurality of apertures for discharge of liquid flowing from said passageway, and a flexible mop head fitted over said tubular frame assembly, said tubular frame assembly including connecting means defining externally threaded sleeves threadedly connecting within said laterally extending ends, said connecting means having axial passages formed therethrough, said ends of the frame assembly extending through said passages and being flared outwardly, means urging said flared ends into engagement with said connecting means to form a fluid tight seal therebetween when said connecting means are securely affixed to the transverse member.

5. The car wash mop that is defined in claim 4 wherein said means urging said flared ends into engagement with said connecting means comprises a compression spring.

6. The car wash mop that is defined in claim 4, wherein said tubular frame assembly includes a frame member formed in a side-by-side circular loop configuration and located substantially in a single plane, and said ends of said frame assembly are at the central portion of said side-by-side circular configuration.

7. The car wash mop that is defined in claim 6, wherein said flexible mop head includes a pocket that removably fits over said tubular frame assembly.

8. The car wash mop that is defined in claim 7, wherein said flexible mop head has a plurality of fabric strands attached thereto.

9. The car wash mop that is defined in claim 6, wherein said fabric mop has a plurality of perforations formed therein to permit the flow therethrough of liquid discharged from said tubular frame assembly.

10. The car wash mop that is defined in claim 9, wherein said perforations are in close proximity to said apertures of the tubular frame assembly when said mop head is fitted over the tubular frame assembly.

* * * * *